United States Patent [19]

McKechnie

[11] Patent Number: 4,792,137

[45] Date of Patent: Dec. 20, 1988

[54] MONITORING AND INDICATING APPARATUS FOR USE IN THE GAME OF ROULETTE

[76] Inventor: Ian C. McKechnie, 8524 N. 50th Pl., Scottsdale, Ariz. 85253

[21] Appl. No.: 497,194

[22] Filed: May 23, 1983

[51] Int. Cl.[4] ..... A63B 71/06

[52] U.S. Cl. ..... 273/138 A; 273/142 B; 364/412

[58] Field of Search ..... 273/1 E, 1 ES, 138 R, 273/138 A, 142 R, 142 B; 364/410–412

[56] References Cited

U.S. PATENT DOCUMENTS

| | | | |
|---|---|---|---|
| 4,017,081 | 4/1977 | Windisch | 273/138 A |
| 4,321,673 | 3/1982 | Hawwass et al. | 273/138 A |
| 4,396,193 | 8/1983 | Reinhardt et al. | 273/138 A |

*Primary Examiner*—Maryann Lastova

*Attorney, Agent, or Firm*—Warren F. B. Lindsley

[57] ABSTRACT

An electronic implementation of the roulette wheel and the associate layout which provides electronic selection and automatic recognition and illumination of winning numbers and bets.

1 Claim, 4 Drawing Sheets

POWER SUPPLY
ON/OFF
CLOCK
TS
START
STOP
#23 LIGHT
#00 LIGHT
#8 LIGHT
#5 LIGHT
#34 LIGHT
#0 LIGHT
RED
BLACK
ODD
EVEN
1-12
13-24
25-36
1-18
19-36
C1
C2
C3
B+
B-

MONITORING AND INDICATING APPARATUS FOR USE IN THE GAME OF ROULETTE

BACKGROUND OF THE INVENTION

This invention relates to the game of roulette and, more particularly, to improved equipment intended for use in connection with the playing of the game. The improved equipment aids in the recognition of winning bets resulting from the selection of a given number on the roulette wheel. In one embodiment of the invention, the wheel is replaced by an electronic device which randomly selects the winning number.

DESCRIPTION OF THE PRIOR ART

As described in the Encyclopedia Britannica, roulette is a gambling game of French origin that is played in nearly all the gambling casinos of Europe and America.

Equipment for roulette consists of a table in which is mounted a compartmented wheel and one or two layouts, usually enameled on green cloth. Any number of persons may play, betting only against the bank (proprietor of the game). The tourneur, one of the croupiers in attendance, calls, "Make your bets, gentlemen," whereupon players indicate their bets on the number o classification of numbers they hope will win. The tourneur then spins the wheel in one direction and in contrarotation spins a small ivory ball which, when the ball slows down sufficiently, falls into one of the numbered compartments and thus designates the winning numbers. When it appears to the tourneur that the ball will soon come to rest, he calls, "The betting is closed." No bet may be placed thereafter.

When the ball rests, the tourneur announces the winning number and whether it is red or black, odd or even, low (1 to 18) or high (19 to 36), etc. The bank pays winning bets at the established rates and collects losing bets, which a croupier gathers in with a rake.

One common form of the roulette wheel is marked off into thirty-eight segments including thirty-six segments that are individually numbered from one to thirty-six, a thirty-seventh segment that is numbered "0" and the thirty-eighth segment numbered "00". The first thirty-six segments are individually colored either red or black and the "0" and "00" segments are a third color.

The layout accompanying this common form of wheel typically includes thirty-eight numbered squares in colors corresponding to the colors on the wheel. A player may place his coin on any of these thirty-eight squares to bet on the occurrence of a specific number. In addition, the numbers 1–36 are arranged in twelve rows and three columns. The thirty-six numbers are also classified in three groups according to their ranking. The first of the three groups includes the numbers 1–12, the second group includes the numbers 13–24 and the third group, 25–36.

Additional areas are included on the layout which permit the player to bet that the winning number will fall into one of a number of classifications. A first area is marked "LOW" and a second area "HIGH" to indicate a number from 1–18 or from 19–36, respectively. A third area is marked "ODD" and a fourth area "EVEN" to permit betting that the selected number will fall into one of these categories. A fifth area is marked "RED" and a sixth area is marked "BLACK" to accommodate betting that the winning number will be either red or black. A player may place his coin or token on any of the individual numbers, on "0", on "00", or on any of the six areas just described. In addition, he may bet on one of two adjacent numbers by placing his coin on the line between the two numbers. He may bet that the winning number will be shown in one of the three columns by placing his coin on an area below the selected column. He may bet on any group of three numbers included in the same horizontal row; he may bet on two adjacent columns, on two adjacent rows, groups of twelve, on any of four adjacent numbers, or on two adjacent rows. He may bet on "0" together with "00" or on either or both of these selections together with an adjacent number or numbers.

It will be recognized that the selection of a given number on the wheel may result in a winning bet by virtue of its falling into one of a large number of classifications. Thus, when there are several players placing their bets at a given table with each player placing a number of bets at each turn of the wheel, it is no easy matter to recognize immediately all of the winning bets.

In the customary manner of running the game, the croupiers remove the losing bets from the table with a rake. In order to keep the game moving at a fast pace, this action occurs very rapidly. For the inexperienced player, the coins may be removed before he has had the opportunity to determine for himself whether or not he has a winning bet; for the relatively inexperienced croupier or for a croupier who may not be up to par because of long hours or distracting circumstances, there is always the possibility of error. A better means for displaying or calling attention to a winning bet of any category is thus needed, both as a means for speeding up the game and for reducing the chance for error in the recognition of winning bets.

The present invention discloses improved equipment for the game of roulette which will accomplish the above benefits.

SUMMARY OF THE INVENTION

In accordance with the invention claimed, new and improved equipment is provided for use in the game of roulette. In a first embodiment of the invention, a specially-lighted layout is employed in combination with an electrically-connected roulette wheel in which a conductive ball completes electrical connections in the roulette wheel and thereby causes the illumination of appropriate areas on the layout to indicate the winning bets.

It is, therefore, one object of this invention to provide improved equipment for use in the operation of the game of roulette.

Another object of this invention is to provide in such equipment means for drawing attention to winning bets that have resulted from the selection of a given number on the roulette wheel.

A further object of this invention is to provide, in connection with such improved equipment, automatic means for lighting the winning areas of the layout in response to the selection of a given number by means of the roulette wheel.

A still further object of this invention is to provide a special form of roulette wheel which, together with a conductive bal and electronic control circuits, will permit such automatic selection to be effected.

A still further object of this invention is to provide a solid state electronic embodiment for selecting a winning number, the electronic means replacing the manually operated roulette wheel.

A still further object of this invention is to insure through the provision of such improved equipment a more rapid and accurate determination and recognition of winning bets so that the pace of the game may be quickened without detriment to those engaged in the game.

Further objects and advantages of the invention will become apparent as the following description proceeds, and the features of novelty which characterize the invention will be pointed out with particularity in the claims annexed to and forming a part of this specification.

BRIEF DESCRIPTION OF THE DRAWINGS

The present invention may be more readily described with reference to the accompanying drawings, in which.

DESCRIPTION OF THE PREFERRED EMBODIMENT

Figure 1:
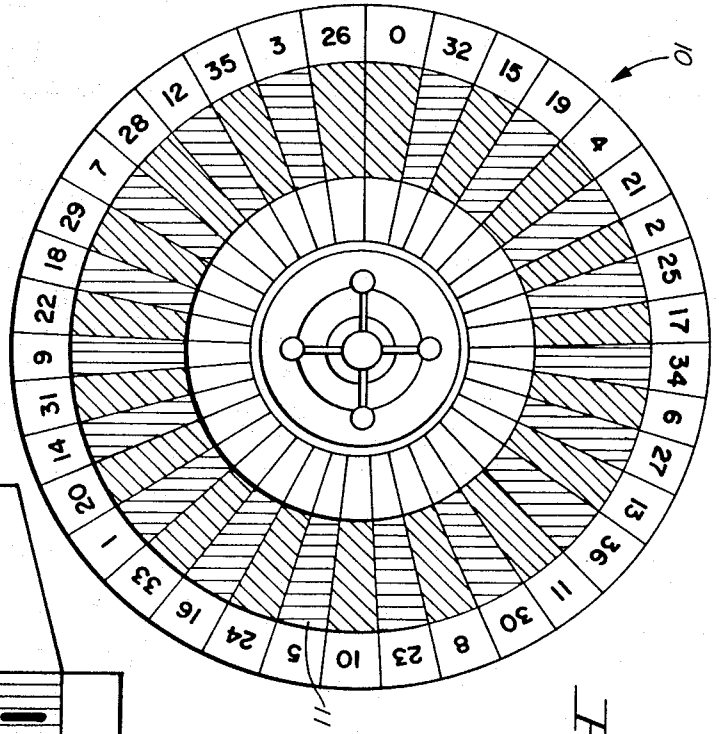
FIG. 1 is a top view of a conventional roulette wheel.
Figure 2:
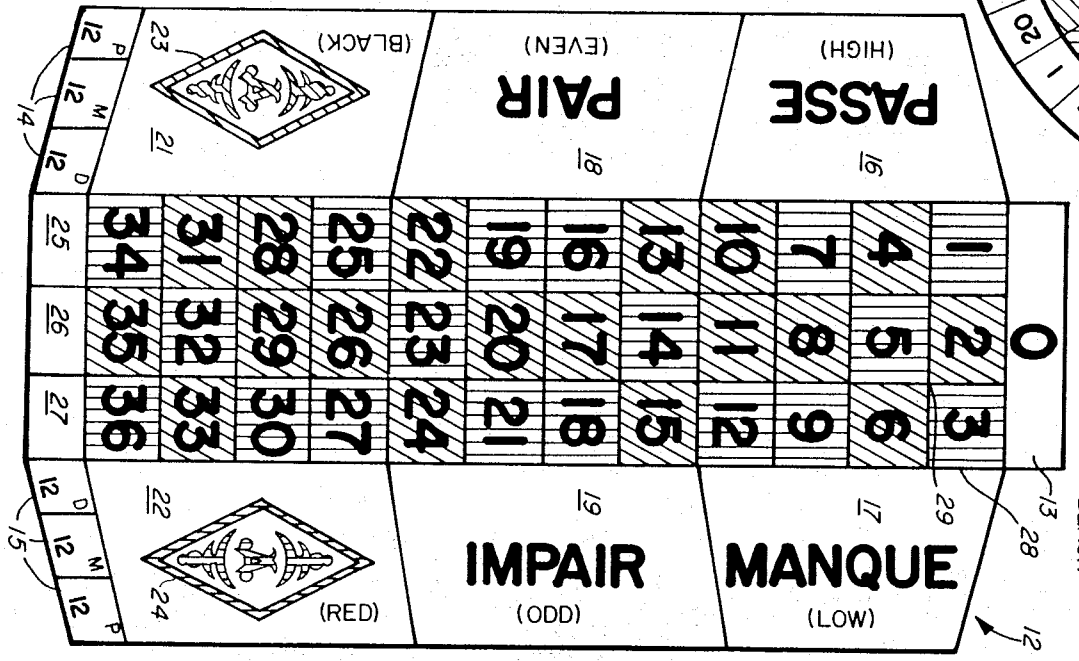
FIG. 2 is a plan view of a conventional roulette cloth or layout that is used for placing bets on numbers selected by means of the wheel of FIG. 1.

Referring more particularly to the drawings by characters of reference, FIGS. 1 and 2 show the numerical patterns employed in the conventional roulette wheel and layout as described in the Encyclopedia Britannica. As shown in FIG. 1, the periphery of roulette wheel 10 is divided into thirty-seven equal segments numbered from zero through thirty-six in random order. Adjacent each numbered segment and extending radially inwardly is a red or black area 11 (alternately shaded in FIG. 1 to illustrate red or black, respectively) that identifies the associated number as one of the red or black classification of numbers.

Layout 12 of FIG. 2 illustrates that the same numbers are assigned to thirty-seven areas arranged in rows and columns. The thirty-six areas numbered "1-36" are arranged in three columns and twelve rows numbered in sequence beginning at the top of the left-hand column with the number "1" moving from left to right in each row and progressing downward from the top row to the bottom so that the last area at the bottom of the third column is assigned the number "36". An area 13 located above the top row is marked "0". The numbered areas of the layout 12 are shaded in contrast to illustrate the color red or black in correspondence with the red and black identification of each number as established on the wheel 10. Thus, for example, the number 34 which has an adjacent red area on wheel 10 has a red background on layout 12, while number 6 with its adjacent black area on wheel 10 has a black background on layout 12.

On the layout 12, the numbered areas "1"-"12" form the first or "premiére" dozen, the areas "13"-"24" form middle or "milieu" dozen and the areas "25"-"36" form the last or "derniére" dozen, the three "dozens" being represented as "$12^P$", "$12^M$" and "$12^D$", respectively. To bet that the selected number will fall in a particular one of the three dozens, a player places his coin on one of the three areas 14 at the lower left corner of the layout 12 or on one of the identically marked three areas 15 at the lower right corner of the layout.

At the left of the "first dozen" is an area 16 marked PASSE (HIGH), while at the right of the "first dozen" is an area 17 marked MANQUE (LOW). A coin placed on area 16 represents a bet that the selected number will fall in the range from "19"-"36", while a coin placed on area 17 is a bet that the selected number will lie in the range "1"-"18".

At the left of the "middle dozen" is an area 18 marked PAIR (EVEN) and at the right of the "middle dozen" is an area 19 marked IMPAIR (ODD). These areas are employed for betting that the selected number will be even or odd.

To the left and right of the "last dozen" are areas 21 and 22, respectively. In area 21 there is a black design 23, while in area 22 there is a red design 24. A coin placed on the black design 23 or on the red design 24 is a bet that the selected number will be black or red, respectively. To bet that the selected number will be shown in the first, second or third columns the player places his coin in the area 25, 26 or 27, respectively, which lie directly below the three columns.

There are additional opportunities to bet on other classifications of numbers. For example, a coin placed on the right-hand border 28 of the number "3" is a bet that the selected number will be shown in the top row. A coin placed at the center 29 of the four areas marked "2", "3", "5" add "6" is a bet that one of these four numbers will be selected. In a similar fashion it is possible to bet on adjacent rows, adjacent columns, adjacent "dozens", etc. The classifications are thus seen to be numerous and the recognition of winning bets is thus correspondingly difficult.

Figure 3:
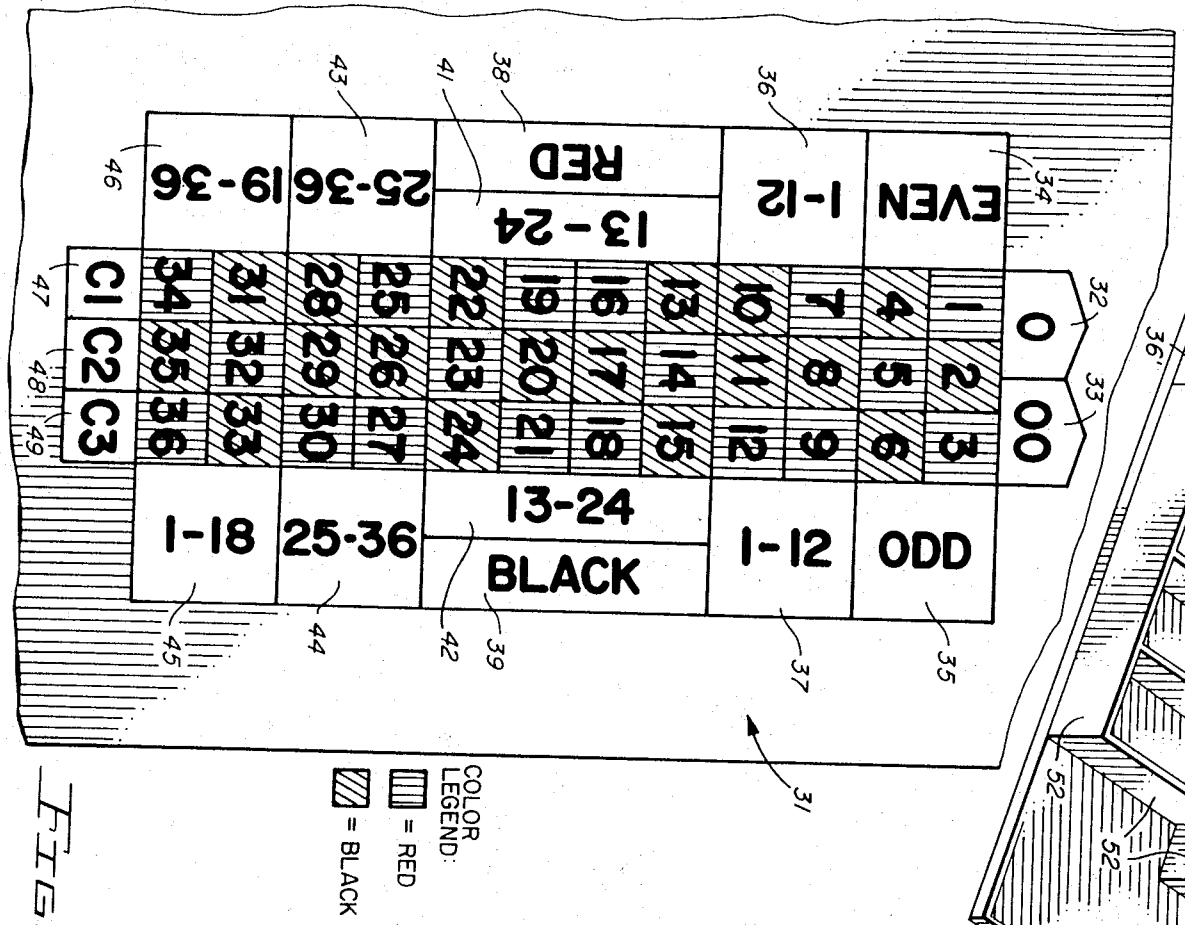
FIG. 3 is a plan view of an improved apparatus used for placing bets, indicating winning numbers and classifications thereof in the game of roulette.

The layout 31 of the invention as shown in FIG. 3 is similar in pattern to the more conventional layout 12 of FIG. 2. The areas numbered "1" through "36" are again arranged in three columns and twelve rows The number "0" is located in an area 32 at the top of the first and second columns; an area 33 numbered "00" is located just to the right of the area 32. Additional areas provided in the layout 31 include an area 34 for betting on an even number, an area 35 for betting on an odd number, two areas 36 and 37 for betting on the first dozen, an area 38 for betting on a red number, an area 39 for betting on a black number, to areas 41 and 42 for betting on the middle dozen two areas 43 and 44 for betting on the last dozen, an area 45 for betting on the lower half ("1"-"18"), an area 46 for betting on the upper half ("19"-"36"), and three areas 47, 48 and 49 for betting on the three columns C1, C2 and C3.

In this embodiment of the invention, each of the areas of layout 31 that have just been enumerated is equipped to be appropriately lighted upon the selection of a winning number. A coin lying on a lighted area is then readily recognized as a winning bet. By way of example, if the number "17" is selected, the following areas in addition to the area marked "17" will be lighted:

| Area | Reason |
|---|---|
| 35 | "17" is an odd number |
| 39 | "17" is a black area |
| 41 & 42 | "17" is in the middle dozen |
| 45 | "17" is in the lower half |
| 48 | "17" is in the second column |

If a coin has been placed on a line bordering a lighted area, the coin extends into a lighted area and is also recognized as a winning bet. The croupier as well as the players can thus distinguish at a glance between winning and losing bets.

In the three-dimensional representation of the layout 31 shown in FIG. 4, a portion of the playing surface has been cut away for better visibility of the structure below. It is seen that beneath each of the areas shown on the playing surface there is an enclosed compartment. Thus, for example, beneath area 34 under the word "EVEN" there is a compartment 34'; beneath area 36 under "1-12" is a compartment 36'; etc.

In the structure of layout 31 the numbered and labeled faceplate or top surface 50 is translucent in the colors red, black and other colors as appropriate. Opaque lines 51 outline the various areas employed for showing the selected number and the winning bets. Opaque markings are also employed for the numbering and lettering of the various areas. The walls 52 which form the compartments 34', 36', etc. are constructed of an opaque material and are formed in a modified egg crate pattern that conforms with the boundaries of the various areas on the top surface 50. The structure of the layout 31 is completed by an opaque horizontal baseplate 53.

Figure 5:
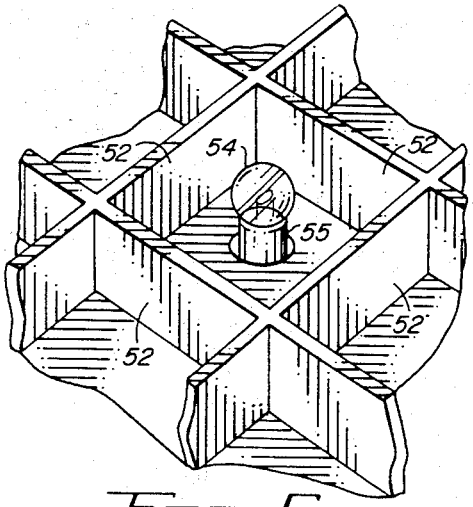
FIG. 5 is an enlarged detailed view of a single compartment of the structure shown in FIG. 4.
Figure 4:
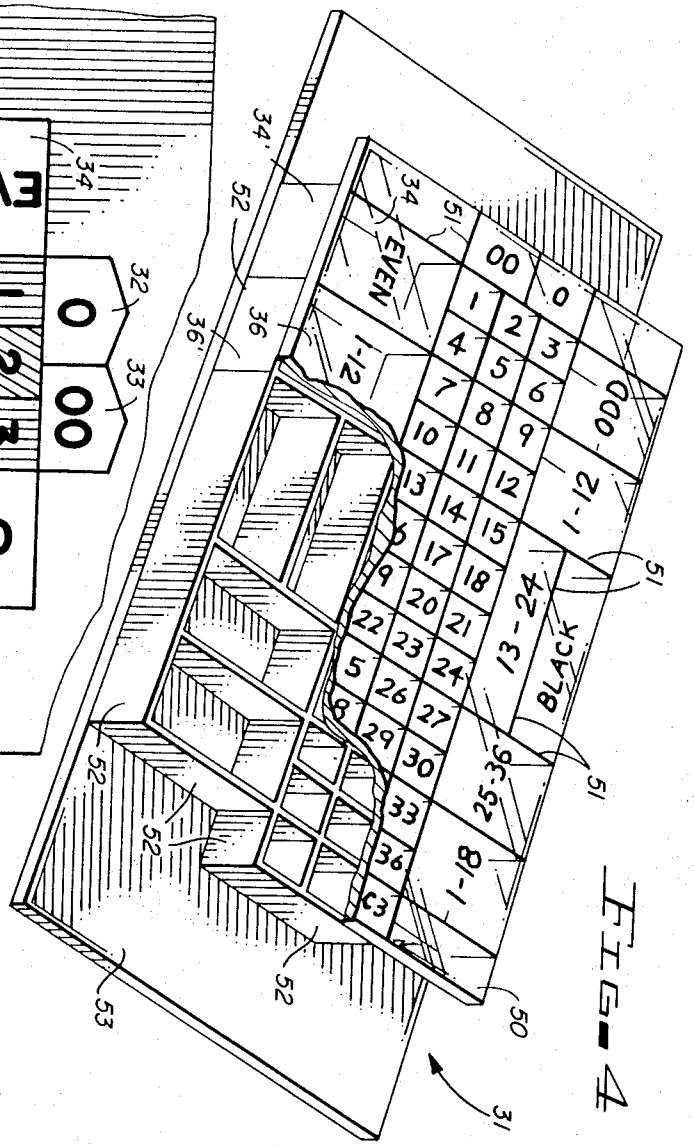
FIG. 4 is a perspective view of the apparatus shown in FIG. 3, partially cut away to reveal its basic structure.

As shown in FIG. 5, each of the compartments of FIG. 4 is equipped with a lamp 54 mounted in a socket 55. Also shown in FIG. 5 are the compartment walls 52. For simplicity, the lamps and sockets are not shown in FIG. 4.

Figure 6:
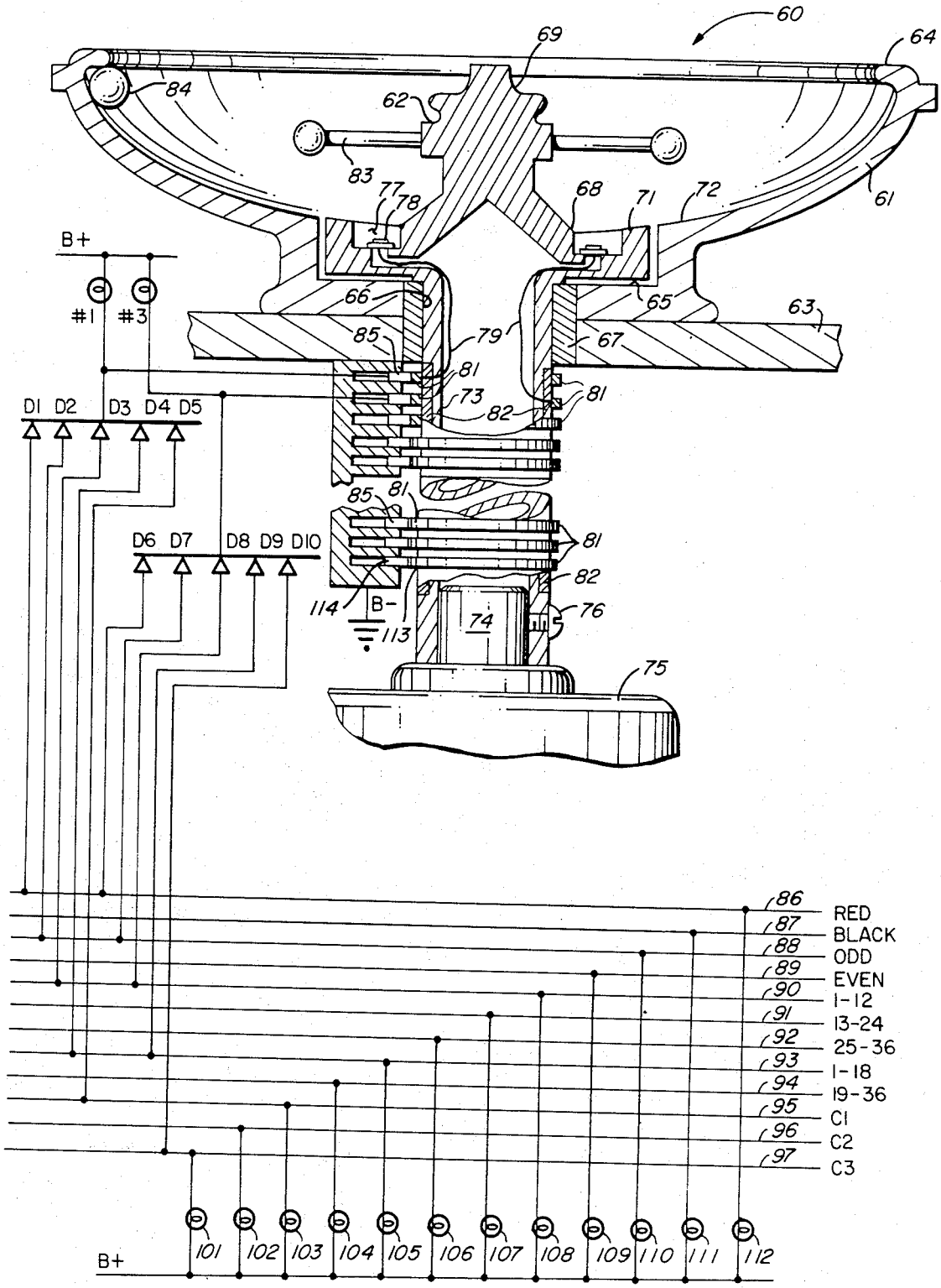
FIG. 6 illustrates a cross-sectional view of an improved roulette wheel embodying the invention together with a partial schematic of electric circuits employed for automatic illumination of appropriate areas of the layout shown in FIGS. 3-5.

The specially constructed roulette wheel 60 of FIG. 6 is employed in conjunction with the layout just described for the automatic energization of the appropriate area of the layout.

Roulette wheel 60 comprises an outer stationary bowl 61 and an inner rotating member 62. The stationary bowl 61 is secured to a platform or table top 63.

Bowl 61 has a shallow circular form with an inwardly turned rim 64. In the center of the bowl there is a centered circular depression 65 and a centered cylindrical opening 66. A short cylindrical sleeve 67 secured in the opening 66 passes through a matching cylindrical opening in platform 63 to secure the position of bowl 61 on platform 63. Bowl 61, sleeve 67 and platform 63 are constructed of an electrically insulating material.

Column-like, rotating member 62 is coaxially mounted within bowl 61 and comprises a lower portion in the form of a dish 68 and an upper extension 69. Dish 68 fits inside depression 65 and is freely rotatable therein. The upper or rim surface 71 of dish 68 is aligned with the adjacent inner peripheral surface 72 of bowl 61 so that the two surfaces are approximately continuous. Integral with dish 68 is a centered hollow cylindrical shaft 73 which extends vertically downwardly through stationary sleeve 67, sleeve 67 serving as a bearing surface for the rotation of shaft 73. Dish 68 and shaft 73 are electrically conductive. The lower end of shaft 73 fits over one end of a shaft 74 of a drive motor 75 and is secured thereto by a screw 76. The surface of the annular depression 77 of bowl 61 is divided into thirty-eight uniformly-sized contiguous pockets. Adjacent each pocket there is inscribed one of the numbers "1" through "36", "0" and "00" in the customary pattern and colors of the roulette wheel. At the center of each pocket is mounted an electrical contact 78. Each of the thirty-eight contacts 78 is connected by means of an electrical conductor 79 to a corresponding slip ring 81 of a slip ring assembly 82 that is supported on the outer surface of shaft 73. Conductors 79 pass through the hollow interior of shaft 73 making connections between the thirty-eight contact 78 and the corresponding thirty-eight slip rings 81. The upper extension 69 of member 62 is largely decorative so that its dimensions and form may be altered at will or it may be eliminated entirely. The identification of the individual pockets 77 might be accomplished by means of opaque numerals arranged on rim surface 71.

An electrically conductive ball 84 is spun by the dealer or "tourneur" inside bowl 61 in a direction opposite the rotation of member 62, the member 62 being slowly rotated by motor 65. As its initially high velocity about the periphery of bowl 61 diminishes, the force acting on ball 84 causes it to roll downwardly over surfaces 72 and 71 of bowl 61 and dish 68 and into one of the pockets of depression 77 where it makes electrical contact between dish 68 and contact 78.

Each of the slip rings 81 is connected through a brush 85 and a lamp selection circuit. Two of the thirty-eight lamp selection circuits involved are shown in FIG. 6.

One of the two lamp selection circuits shown comprises lamp #1 and diodes D1-D5. The five diodes, D1-D5, have their cathodes connected to one terminal of lamp #1. The cathodes of diodes D1-D5 are also connected through a brush 85, a slip ring 81 and a conductor 79 to contact 78 of dish 68 that is identified by numeral "1". The other terminal of lamp #1 is connected to the positive side of a d-c voltage source designated B+. The anodes of the five diodes D1-D5 are connected to five of twelve "number group busses" 86-97 shown a twelve parallel lines individually denoted, "RED", "BLACK", "ODD", "EVEN", "1-12", "13-24", "25-36", "1-18", "19-36", "C1", "C2" and "C3". Connected to each of the twelve busses 86-97 from source B+ is one of twelve indicator lamps 101-112. The five diodes are selectively connected to the number groups busses as appropriate for proper identification of the winning bets. Thus, because the number "1" is a "red" number as shown in FIG. 3, the anode of D1 is connected to the "RED" bus 86 and there is no connection to "BLACK" bus 87. Because the number "1" is an odd number, the anode of D2 is connected to the "ODD" bus 88. The anode of D3 connects to bus 90 because the number "1" falls into the classification "1-12", the anode of D4 connects to bus 93 ("1-18") , and the anode of D5 connects to bus 95 because the number "1" lies in column one (C1).

It will now be seen that when ball 84 falls into the #1 pocket of depression 77, the appropriate indicator lamps are energized. First, there is seen to be a current path beginning at B+ and flowing through lamp #1, through the connected brush 85, slip ring 81 and conductor 79 to the contact 78 labeled "1", through the ball 84 to dish 68, and through the shaft 73 to a 39the slip ring 113 in contact with the shaft and associated brush 114 to the negative side of the d-c supply designated B−. Lamp #1 is thus energized to light the area marked "1" in the layout of FIG. 3. In addition, there is a current path from B through lamp 103, through diode D5, and again to B− through the connected brush 85, slip ring 81, conductor 79, contact 78, ball 84, dish 68, ring 113 and brush 114. Similarly, there are paths from B+through lamps 105 and diode D,, lamp 108 and diode D3, lamp 110 and diode D2, lamp 112 and diode D1. Lamps 112, 110, 108, 105 and 103 are thus energized correctly indicating that the number "1" falls into the classifications "RED", "ODD", "1-12", "1-18" and "C1".

By way of further illustration, the selection circuit shown for number "3" is shown to comprise a lamp #3 that is connected between B+and the commonly-connected cathodes of five diodes, D6-D10, their cathodes also connected through a dedicated brush 85, slip ring 81 and a conductor 79 to a contact 78 located in the pocket of depression 77 designated "3". The anodes of the five diodes D6-D10 are connected, respectively, to busses 86 (RED), 88 (ODD), 90 (1-12), 93 (1-18) and 97 (C3). It is noted that the number "3" fits into the same classifications as the number "1" except that it lies in the third column (C3) rather than in the first (Cl). In this case, lamps #3, 112, 110, 108, 105 and 101 are energized correctly indicating "RED", "ODD", "1-12", "1-18" and "C3". Because there are two areas on layout 31 to indicate "1-12", a second lamp 108 will be connected in parallel with the lamp 108 shown in FIG. 6. Additional parallel lamps will be required to light duplicate areas "13-24", "25-36" and "1-18". Additional selection circuits are provided for the remaining sectors of the roulette wheel. For simplicity, these are not shown in FIG. 6.

A practical implementation of the invention has thus been illustrated with the desired functionality for automatically indicating on the layout the selected number and the associated winning bets.

A second embodiment of the invention substitutes an electronic number selection means for the electromechanical roulette wheel of FIG. 6.

Figure 7:
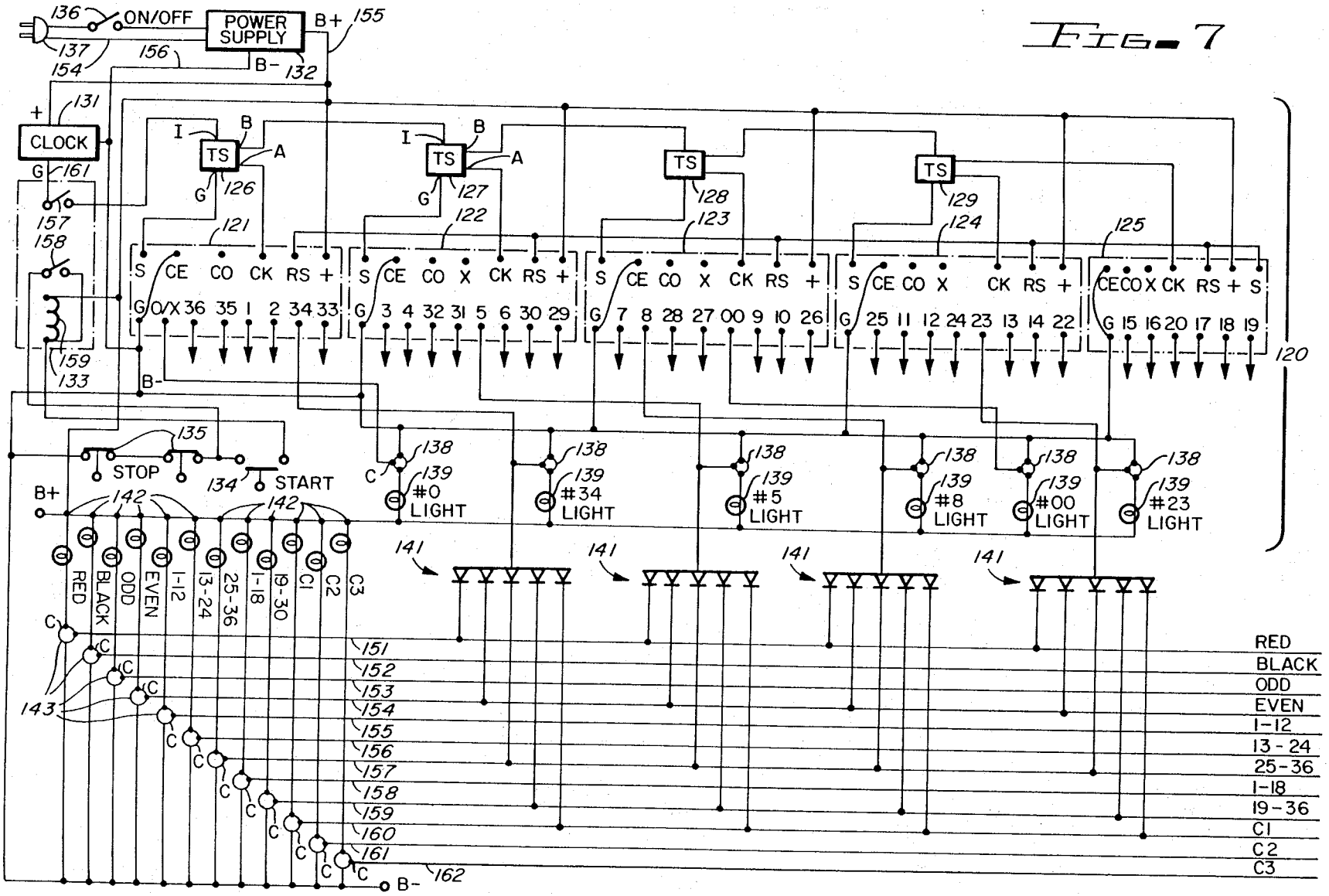
FIG. 7 is a schematic diagram of a further embodiment of the invention incorporating a electronic means for the selection of a winning number.

The electronic selection means 120 as shown in FIG. 7 comprises five decade counters 121-125, four transfer switches 126-129, a clock 131, a d-c power supply 132, a latching relay 133, a momentary "START" switch 134, one or more momentary "STOP" switches 135, a power "ON/OFF" switch 136, a power plug 137, thirty-eight lamp driver switches 138, and thirty-eight winning number indicator lamps 139. The remaining circuits including thirty-six diode arrays 141, twelve layout area indicator lamps 142, and twelve layout area driver switches 143, which respond to the selection means 120, automatically causing the appropriate areas of the layout to be illuminated for the identification of winning bets.

The decade counters 121-125 are available from a number of semiconductor manufacturers including National Semiconductor. The device produced by National Semiconductor is identified by their part number CD4017BC, which is described in the 1978 edition of the CMOS DATABOOK (National Semiconductor, pages 2-45 to 2-49). Each decade counter 121-125 has a clock input terminal CK, a reset terminal RS, a positive voltage terminal +, a ground terminal G, a clock enable terminal CE, a carryout terminal CO (not used), and ten output terminals, the first being identified with "X" and the last one used by the letter "S" in FIG. 7, since not all ten output terminals of each counter are used. Those that are used are identified by the numerals 0, 00, and "1"-"36", these numerals corresponding to the thirty-eight winning numbers for the game. Thus, for example, the output terminals used of counter 121 are numbered "0"+"X", "36", "35", "1", "2", "34", "33", and "S", only eight being used. A reset signal in the form of a positive pulse received at reset terminal RS sets nine of the output terminals to zero, and the "0"+"X" terminal to a positive level or logical "1". The next positive clock pulse received at clock terminal CK sets the second output terminal 36 to a positive level and returns the first output terminal "0"+"X" to zero. Each succeeding clock signal sets the next output terminal positive, progressing in order from left to right, the last being the S terminal, which activates the transfer switch 126.

The transfer switches 126-129 may be implemented in any of a number of ways, using integrated circuits or discrete semiconductor devices. Each switch has an input terminal I, two output terminals A and B and a gating terminal G. If the gating terminal G is at ground potential, the input signal received at terminal I is delivered at output terminal A; if the gating terminal G is at a positive potential, the input signal is delivered at output terminal B. An example of such a transfer switch is illustrated in FIG. 8.

Figure 8:
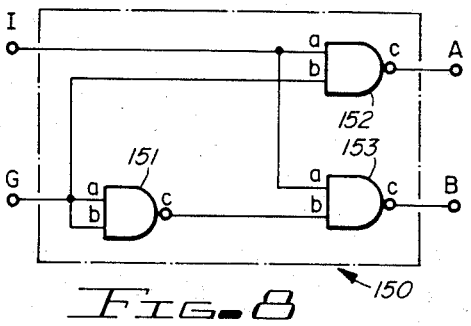
FIG. 8 is a schematic drawing of an electronic transfer switch that may be employed in the embodiment shown in FIG. 7.

The transfer switch 150 of FIG. 8 comprises three NAND gates 151-153. Each NAND gate has two input terminals a and b and an output terminal c. If both input terminals a and b are positive (high), the output terminal c is low (near zero volts). If either input terminal is low, the output terminal is high. In transfer switch 150, gate 151 has both input terminals connected to the gating terminal G. Gate 152 has its first input terminal a connected to input terminal I; its input terminal b is connected to gating terminal G; and its output terminal c is connected to output terminal B of switch 150. Gate 153 has its input terminal a connected to input terminal I; its input terminal b is connected to output terminal c of gate 151; and its output terminal c is connected to output terminal A of switch 150. When input terminal G is positive, a positive signal exists at terminal b of gate 152 to enable gate 152 to transmit input signals received at its input terminal a. At this time, the inverted (low) gating signal received by gate 153 at its input terminal b from gate 151 blocks passage of the input signal through gate 153. When the gating signal is low, passage through gate 152 is blocked while the inverted gating signal received by gate 153 is high so that this gate now passes the input signal to output terminal A.

Thus, when the 8th or S terminal of counter 121 goes high or to a logical "1", the clock pulse is simultaneously transferred by transfer switch 126 to the CK input of counter 122 resulting in its output terminal "X" going to zero and its output terminal 3 going high or to a logical "1". In every case (i.e., for all counters 121-125) the S signal is taken from the next higher count following the last numerical output signal.

The clock 131 is a simple multivibrator circuit available as an integrated circuit in many types and forms. In this case the functional requirements are very simple. It should deliver a square-wave output signal that switches between a positive voltage and ground at a relatively low frequency. In the first reduction to practice of the invention, the clock frequency was in the range of 75-100 hertz. This frequency range is sufficiently rapid to prevent the lights under "0", "00" and "1-36" from lighting while allowing the lights under the groups "RED", "BLACK", etc. to flash on and off.

The power supply 132 converts utility power (typically 120 volts, 60 hertz) to a positive d-c voltage. The 120 volts is supplied by a power cord 154 and plug 137. The supply is turned "on" and "off" by means of switch 136.

The positive output terminal 155 of supply 132 is connected to the positive voltage bus B+ and the negative output terminal 156 is connected to the negative or ground bus B−. The voltage source terminals (+) and the ground terminals (G) of the clock 131 and the counters 121-125 are connected, respectively to the positive bus B+ and the ground bus B−. Where the electronic transfer switches 126-129 are of the type shown in FIG. 8, similar connections from B+ and B− are made to these circuits, although such connections are not shown in the drawings.

The latching relay 133 has two normally-open contacts 157 and 158 and a coil 159. These contacts close when voltage is applied across coil 159. The output signal from terminal 161 of clock 131 is connected through contact 157 to input terminal I of transfer switch 126. Coil 159 has its upper end connected to B+; its lower end is connected through the normally-open START switch 134 and through the serially-connected, normally-closed STOP switches 135 to B−. Contact 158 of relay 133 is connected in parallel with START switch 134. When the START switch is closed momentarily, coil 159 is energized and contact 158 closes to latch the relay 133 in the energized condition. Contact 157 also closes at this time to deliver the clock signal to switch 126.

It will be noted that each of the transfer switches 126-129 is associated with one of the counters 121-124. In each case, the signal S from the associated counter is connected to he gating terminal G of the switch and the output terminal A of the switch is connected to the clock terminal CK of the counter. Switch 126 has its output terminal B connected to input terminal I of switch 127, switch 127 has its output terminal B connected to input terminal I of switch 128, switch 128 has its output terminal B connected to input terminal I of switch 129, and switch 129 has its output terminal B connected directly to the clock terminal CK of counter 125.

The S terminal of counter 125 is connected to the reset terminals of all the counters 121-125.

Operation of the electronic selection means 120 occurs as follows. When relay 133 closes in response to a momentary closure of START switch 134 as described earlier, the clock signal delivered to terminal I of switch 126 is transferred initially through output terminal A to the clock terminal CK of counter 121. Counter 121 is advanced one count by each clock pulse received, delivering first a positive pulse at terminal "0", then at terminal "36" and then sequentially at "35", "1", "2", "34" and "33". At the next clock pulse a positive pulse delivered from terminal S to gate G of switch 126 alters the state of switch 126 so that no additional clock pulses are received by counter 121 from switch terminal A. Simultaneously with the altering of the state of switch 126, the same clock pulse is delivered via terminal B of switch 126 to input terminal I of switch 127. Switch 127 delivers the clock signal through its terminal B of switch 126 to output terminal A to clock terminal CK of counter 122. Counter 122, which up to now had a high or logical "1" on its "X" output terminal (which was open circuit), now counts up through 3, 4, 32, 31, 5, 6, 30, 29, then its terminal S goes positive whereupon switch 127 operates to transfer the clock signal via switch 128 to counter 123. The clock signal is transferred sequentially in this manner to each of the counters 121-125 until counter 125 completes its count to terminal S, whereupon the signal S resets all the counters back to a high or logical "1" on their "X" output terminals. It should be noted that only the "X" terminal of counter 121 is connected to a layout number. The "X" terminal of the other circuitry are open circuit. The counting sequence then starts over again beginning with counter 121. It is seen that any instant of time one and only one of the counters 121-125 will have a positive signal at only one of its output terminals. Thus, if at any time one of the STOP switches is momentarily operated (opened) to unlatch relay 133, one of the thirty-eight output signals will be positive or at a logical "1" while all of the other counter output terminals will be at zero volts or open circuit.

Each of the counter terminals is connected, first of all, to energize one of the thirty-eight indicator lamps 139. Output terminal "0", for example, is connected to the control terminal C of switch 138 which has its power terminals connected in series with the #0 LIGHT or lamp 139 across the B+ and B− busses. A positive signal at terminal "0" and hence at terminal C of switch 138 will render switch 138 conductive and the #0 LIGHT will be energized to illuminate the numeral "0" on the layout as described earlier. Individual switches 138 are similarly connected to each of the other thirty-seven counter output terminals to control the illumination of the selected numbers. The switches 138 may be implemented in a conventional manner by means of transistors, integrated circuits or other electronic means.

Thirty-six of the counter output signals (all but the "0" and "00" signals) are also employed to control the illumination of the "winning" areas of the layout. This is accomplished through the use of the diode arrays 141 which access the twelve driver switches 143 via the twelve control busses 151-162.

Each of the lines 151-162 is seen to be identified as representing a given winning classification (RED, BLACK, etc.). Each line is also connected to the control terminal C of an associated switch 143 which has its power terminals serially connected with an indicator lamp 142 of the same classification. The serially connected switch and lamp are connected between the B+ and B− terminals so that a positive signal at the control terminal C of the switch causes the associated lamp to be energized. Thus, for example, if bus 151 identified as "RED" is energized by a positive signal, the switch 143 associated with the lamp 142 identified as "RED" will be activated to energize the lamp illuminating the "RED" area on the layout.

The diode arrays 141 are employed to energize the appropriate busses 151-162 for each output terminal of the counters 121-125. Thus, by way of example, terminal "34" of counter 121 is connected via five diodes 141 to busses 151 (RED), 154 (EVEN), 157 ("25"-"36"), 159 ("19"-"36") and 160 (Cl), these winning areas being thus correctly identified for the selected number "34".

A totally electronic game of roulette with automatic identification of winning bets may thus be implemented using the circuits of FIG. 7.

Although but two embodiments of the invention have been illustrated and described, it will be recognized by those skilled in the art that numerous variations in circuits and components may be employed to produce the same functionality. All such variations are considered to fall within the spirit of the invention and the scope of the appended claims.

What is claimed is:

1. A game of roulette comprising:

a translucent flat playing surface forming a layout illustrating the same numbers, number groups and color groups as identified on a conventional roulette playing surface arranged in given sequence, color groups, number groups and columns, lighting means positioned underneath said surface for individually illuminating said numbers, color groups, number groups and columns, a solid state clock means, a counting means driven by said clock means at a speed faster than the eye can follow, means for electrically connecting the lighting means of corresponding numbers, color groups, number groups and columns of said layout with said counting means, a first switching means for connecting said clock means to said counting means for actuation of said counting means, and a second switching means for disconnecting said clock means from said counting means for randomly leaving illuminated winning number, color groups, number groups and column.

* * * * *